US011807919B2

(12) United States Patent
Nakagawa et al.

(10) Patent No.: US 11,807,919 B2
(45) Date of Patent: Nov. 7, 2023

(54) ALUMINUM ALLOY FIN MATERIAL FOR HEAT EXCHANGER AND METHOD FOR MANUFACTURING THE SAME

(71) Applicant: UACJ Corporation, Tokyo (JP)

(72) Inventors: Wataru Nakagawa, Tokyo (JP); Atsushi Fukumoto, Tokyo (JP); Junichi Mochizuki, Tokyo (JP); Tatsuya Ide, Tokyo (JP)

(73) Assignee: UACJ CORPORATION, Tokyo (JP)

( * ) Notice: Subject to any disclaimer, the term of this patent is extended or adjusted under 35 U.S.C. 154(b) by 810 days.

(21) Appl. No.: 16/475,942

(22) PCT Filed: Dec. 1, 2017

(86) PCT No.: PCT/JP2017/043268

§ 371 (c)(1),
(2) Date: Jul. 3, 2019

(87) PCT Pub. No.: WO2018/128036

PCT Pub. Date: Jul. 12, 2018

(65) Prior Publication Data

US 2019/0345587 A1 Nov. 14, 2019

(30) Foreign Application Priority Data

Jan. 6, 2017 (JP) ..... 2017-001055

(51) Int. Cl.

| | |
|---|---|
| ***C22C 21/10*** | (2006.01) |
| ***B21B 3/00*** | (2006.01) |
| ***B22D 7/00*** | (2006.01) |
| ***C22F 1/053*** | (2006.01) |
| ***F28F 21/08*** | (2006.01) |

(52) U.S. Cl.

CPC ..... *C22C 21/10* (2013.01); *B21B 3/00* (2013.01); *B22D 7/005* (2013.01); *C22F 1/053* (2013.01); *F28F 21/084* (2013.01); *B21B 2003/001* (2013.01)

(58) Field of Classification Search

CPC ..... B21B 2003/001; B21B 3/00; B22D 11/06; B22D 7/005; C22C 1/02; C22C 21/00; C22C 21/10; C22F 1/00; C22F 1/053; F28D 2021/008; F28F 21/084; F28F 2215/00

USPC ..... 420/531

See application file for complete search history.

(56) References Cited

U.S. PATENT DOCUMENTS

| | | | | |
|---|---|---|---|---|
| 10,408,550 | B2 * | 9/2019 | Murase | B22D 11/0622 |
| 2008/0118393 | A1 | 5/2008 | Oskarsson et al. | |
| 2016/0089860 | A1 | 3/2016 | Kurosaki et al. | |
| 2016/0116234 | A1 * | 4/2016 | Murase | C22C 21/02 165/181 |
| 2016/0187079 | A1 * | 6/2016 | Nakanishi | C22C 21/00 148/552 |
| 2017/0003085 | A1 | 1/2017 | Fukumoto et al. | |

FOREIGN PATENT DOCUMENTS

| | | | | |
|---|---|---|---|---|
| JP | 02240233 | A | * | 9/1990 |
| JP | 4-371369 | A | | 12/1992 |
| JP | 7-90448 | A | | 4/1995 |
| JP | 2008-190027 | A | | 8/2008 |
| JP | 2008-308761 | A | | 12/2008 |
| JP | 2012-26008 | A | | 2/2012 |
| WO | 2014/184880 | A1 | | 11/2014 |
| WO | 2015/141698 | A1 | | 9/2015 |

OTHER PUBLICATIONS

NPL: On-line translation of JP 2008308761 A, filed on Dec. 2008 (Year: 2008).*

NPL: on-line translation of JP 02240233 A, Sep. 1990 (Year: 1990).*

International Search Report dated Feb. 27, 2018, issued in counterpart International Application No. PCT/JP2017/043268 (2 pages).

* cited by examiner

*Primary Examiner* — Jie Yang

(74) *Attorney, Agent, or Firm* — WHDA, LLP

(57) ABSTRACT

An aluminum alloy fin material for a heat exchanger is made of an aluminum alloy including 0.05 mass % to 0.5 mass % of Si, 0.05 mass % to 0.7 mass % of Fe, 10 mass % to 2.0 mass % of Mn, 0.5 mass % to 1.5 mass % of Cu, and 3.0 mass % to 7.0 mass % of Zn, with the balance being Al and unavoidable impurities. In an L-ST plane thereof, second-phase grains having an equivalent circle diameter equal to or more than 0.030 μm and less than 0.50 μm have a perimeter density of 0.30 μm/μm$^2$ or more, second-phase grains having an equivalent circle diameter equal to or more than 0.50 μm have a perimeter density of 0.030 μm/μm$^2$ or more, and specific resistance thereof at 20° C. is 0.030 μΩm or more.

3 Claims, No Drawings

ALUMINUM ALLOY FIN MATERIAL FOR HEAT EXCHANGER AND METHOD FOR MANUFACTURING THE SAME

TECHNICAL FIELD

The present invention relates to an aluminum alloy fin material for heat exchangers, with excellent brazability and high strength after brazing heating, and a method for manufacturing the same. In particular, the present invention relates to an aluminum alloy fin material suitably used as a constituent material for heat exchangers for automobiles, and a method for manufacturing the same.

BACKGROUND ART

Aluminum alloys are lightweight and excellent in strength and thermal conductively, and suitably used as materials for heat exchangers.

In recent years, resource saving and energy saving have become indispensable tasks in every industry. Also in the automobile industry, reduction in weight of automobiles has been advanced to achieve these tasks, and heat exchangers for automobiles are also required to achieve reduction in size and weight. Various methods have been discussed to achieve the tasks. One of the methods is to reduce the thickness of the constituent material.

Heat exchangers made of aluminum alloys are widely used as heat exchangers for automobiles, such as radiators and heater cores. In addition, in recent years, heat exchangers made of aluminum alloys have started to become widespread also as heat exchangers for room coolers. These heat exchangers are formed of a tube material and a header material functioning as a passage of a working fluid, a plate material changing the working direction of the working fluid, a fin material functioning as a medium of heat transportation, and a side plate material to secure durability, and the like, and manufactured by bonding these members at multiple points by brazing. Brazing joint is performed by a process of heating a constituent element including a brazing material to approximately 600° C., supplying a molten brazing filler metal to the joint, filling clearance of the joint with the brazing filler metal, and thereafter cooling the material. In particular, heat exchangers for automobiles generally adopt a method in which the members to which a fluoride-based flux adheres are assembled into a predetermined structure, and thereafter the assembly is subjected to brazing joint in an inert gas atmosphere in a heating furnace.

To reduce the thickness of the fin material for heat exchangers, it is important to achieve both improvement in strength after brazing heating and securement of proper brazability. For this reason, various investigations have been made on the material composition and/or the manufacturing process.

For example, Patent Literature 1 proposes a fin material having excellent strength after brazing and excellent brazability by optimization of the mixing ratio of Si, Fe, and Mn and the homogenization conditions.

In addition, Patent Literature 2 proposes a fin material having excellent strength after brazing by increase in concentrations of Si, Fe, Cu, and Mn.

PRIOR ART DOCUMENTS

Patent Literature

[Patent Literature 1] Japanese Patent Publication No. 2012-026008-A

[Patent Literature 2] Japanese Patent Publication No. H07-090448-A

DISCLOSURE OF INVENTION

However, Patent Literature 1 has the problem that difficulty exists in seeming the durability of the heat exchanger, because the maximum strength after brazing heating is 141 MPa.

In addition, Patent Literature 2 has the problem that securing brazability is difficult because the material has a low melting point.

For this reason, an object of the present invention is to provide an aluminum alloy fin material for a heat exchanger with excellent brazability and high strength after brazing heating, and a method for manufacturing the same.

MEANS FOR SOLVING PROBLEM

The inventors of the present invention have performed diligent researches in view of the situation described above, and found the following: first, with respect to the composition, by controlling the melting point of the material by reducing Fe, increasing Mn, and properly controlling distribution of Si, Cu, and Zn, proper brazability is secured, and a proper sacrificial anode effect of the fin material is secured; secondly, formation of an Al—Mn based intermetallic compound, an Al—Mn—Fe based intermetallic compound, an Al—Mn—Si based intermetallic compound, an Al—Mn—Cu based intermetallic compound, an Al—Mn—Fe—Si based intermetallic compound, and an Al—Mn—Fe—Cu based intermetallic compound (hereinafter these intermetallic compounds are referred to as "Mn-based compound") is controlled to secure predetermined second-phase grain distribution and the solid solution quantity of the solute atoms by adopting a twin-roll type continuous casting rolling method as the casting method, properly controlling the heating temperature in annealing before the cold rolling pass, between passes, and after the pass in the cold rolling process, and properly controlling the rolling shape ratio of cold rolling; and, with this structure, the aluminum alloy fin material with the controlled chemical composition and the controlled metal structure has increased strength after brazing heating because the second-phase grains have a high perimeter density and the solute atoms have large solid solution, and excellent brazability due to a high material melting point. In view of the aforementioned, the inventors of the present invention have made the present invention.

Specifically, the present invention (1) provides an aluminum alloy fin material for a heat exchanger, the aluminum alloy fin material including an aluminum alloy including 0.05 mass % to 0.5 mass % of Si, 0.05 mass % to 0.7 mass % of Fe, 1.0 mass % to 2.0 mass % of Mn, 0.5 mass % to 1.5 mass % of Cu, and 3.0 mass % to 7.0 mass % of Zn, with the balance being Al and unavoidable impurities, wherein in an L-ST plane, second-phase grains having an equivalent circle diameter equal to or more than 0.030 μm and less than 0.50 μm have a perimeter density of 0.30 $\mu m/\mu m^2$ or more, second-phase grains having an equivalent circle diameter equal to or more than 0.50 μm have a perimeter density of 0.030 $\mu m/\mu m^2$ or more, and specific resistance thereof at 20° C. is 0.030 μΩm or more.

The present invention (2) provides an aluminum alloy fin material for a heat exchanger, the aluminum alloy fin material including an aluminum alloy including 0.5 mass % to 1.0 mass % of Si, 0.05 mass % to 0.7 mass % of Fe, 1.0 mass % to 2.0 mass % of Mn, 0.3 mass % to 1.2 mass % of Cu, and 2.2 mass % to 5.8 mass % of Zn, with the balance being Al and unavoidable impurities, wherein in an L-ST plane, second-phase grains having an equivalent circle diameter equal to or more than 0.030 μm and less than 0.50 μm have a perimeter density of 0.30 μm/μm$^2$ or more, second-phase grains having an equivalent circle diameter equal to or more than 0.50 μm have a perimeter density of 0.030 μm/μm$^2$ or more, and specific resistance thereof at 20° C. is 0.030 μΩm or more.

The present invention (3) provides an aluminum alloy fin material for a heat exchanger, the aluminum alloy fin material including an aluminum alloy including 1.0 mass % to 1.5 mass % of Si, 0.05 mass % to 0.7 mass % of Fe, 1.0 mass % to 2.0 mass % of Mn, 0.05 mass % to 0.5 mass % of Cu, and 0.5 mass % to 3.0 mass % of Zn, with the balance being Al and unavoidable impurities, wherein in an L-ST plane, second-phase grains having an equivalent circle diameter equal to or more than 0.030 μm and less than 0.50 μm have a perimeter density of 0.30 μm/μm$^2$ or more, second-phase grains having an equivalent circle diameter equal to or more than 0.50 μm have a perimeter density of 0.030 μm/μm$^2$ or more, and specific resistance thereof at 20° C. is 0.030 μΩm or more.

The present invention (4) provides the aluminum alloy fin material according to any one of (1) to (3), wherein the aluminum alloy further includes at least one selected from 0.05 mass % to 0.3 mass % of Ti, 0.05 mass % to 0.3 mass % of Zr, and 0.05 mass % to 0.3 mass % of Cr.

The present invention provides a method for manufacturing the aluminum alloy fin material according to any one of (1) to (4), comprising:

a casting step of acquiring a sheet-like ingot by a twin-roll type continuous casting rolling method; and a cold rolling step of subjecting the sheet-like ingot to cold rolling with at least one pass, to acquire the aluminum alloy fin material for a heat exchanger, wherein when L (mm) is a contact arc length between a roll and material in cold rolling in the cold rolling step, H (mm) is half of sum of thicknesses on a roller inlet side and a roller outlet side, and L/H is a rolling shape ratio, a minimum value of the rolling shape ratio of each pass of cold rolling in the cold rolling step is 1.0 or more, at least one annealing is performed before a first pass, between a pass and another pass, or after a final pass in cold rolling in the cold rolling step, and a maximum achievable temperature of annealing performed at the highest temperature in the at least one annealing is 370° C. to 520° C.

EFFECTS OF INVENTION

The present invention provides an aluminum alloy fin material with excellent brazability and high strength after brazing heating, and a method for manufacturing the same. The aluminum alloy fin material according to the present invention is suitably used as a constituent material of heat exchangers for automobiles.

EMBODIMENTS

An aluminum alloy fin material (hereinafter also referred to as "aluminum alloy fin material (1) according to the present invention") for a heat exchanger according to a first aspect of the present invention is an aluminum alloy fin material for a heat exchanger, the aluminum alloy fine material made of an aluminum alloy including 0.05 mass % to 0.5 mass % of Si, 0.05 mass % to 0.7 mass % of Fe, 1.0 mass % to 2.0 mass % of Mn, 0.5 mass % to 1.5 mass % of Cu, and 3.0 mass % to 7.0 mass % of Zn, with the balance being Al and unavoidable impurities, wherein in an L-ST plane, second-phase grains having an equivalent circle diameter equal to or more than 0.030 μm and less than 0.50 μm have a perimeter density of 0.30 μm/mm$^2$ or more, second-phase grains having an equivalent circle diameter equal to or more than 0.50 μm have a perimeter density of 0.030 μm/μm$^2$ or more, and specific resistance thereof at 20° C. is 0.030 μΩm or more.

An aluminum alloy fin material (hereinafter also referred to as "aluminum alloy fin material (2) according to the present invention") for a heat exchanger according to a second aspect of the present invention is an aluminum alloy fin material for a heat exchanger, the aluminum alloy fin material including an aluminum alloy including 0.5 mass % to 1.0 mass % of Si, 0.05 mass % to 0.7 mass % of Fe, 1.0 mass % to 2.0 mass % of Mn, 0.3 mass % to 1.2 mass % of Cu, and 2.2 mass % to 5.8 mass % of Zn, with the balance being Al and unavoidable impurities, wherein in an L-ST plane, second-phase grains having an equivalent circle diameter equal to or more than 0.030 μm and less than 0.50 μm have a perimeter density of 0.30 μm/μm$^2$ or more, second-phase grains having an equivalent circle diameter equal to or more than 0.50 μm have a perimeter density of 0.030 μm/μm$^2$ or more, and specific resistance thereof at 20° C. is 0.030 μΩm or more.

An aluminum alloy fin material (hereinafter also referred to as "aluminum alloy fin material (3) according to the present invention") for a heat exchanger according to a third aspect of the present invention is an aluminum alloy fin material for a heat exchanger, the aluminum alloy fin material including an aluminum alloy including 1.0 mass % to 1.5 mass % of Si, 0.05 mass % to 0.7 mass % of Fe, 1.0 mass % to 2.0 mass % of Mn, 0.05 mass % to 0.5 mass % of Cu, and 0.5 mass % to 3.0 mass % of Zn, with the balance being Al and unavoidable impurities, wherein in an L-ST plane, second-phase grains having an equivalent circle diameter equal to or more than 0.030 μm and less than 0.50 μm have a perimeter density of 0.30 μm/μm$^2$ or more, second-phase grains having an equivalent circle diameter equal to or more than 0.50 μm have a perimeter density of 0.030 μm/μm$^2$ or more, and specific resistance thereof at 20° C. is 0.030 μΩm or more.

Specifically, the aluminum alloy fin material (1) according to the present invention, the aluminum alloy fin material (2) according to the present invention, and the aluminum alloy fin material (3) according to the present invention are different in composition of the aluminum alloy forming the alumimun alloy fin material.

Each of the aluminum alloy fin material (1) according to the present invention, the aluminum alloy fin material (2) according to the present invention, and the aluminum alloy fin material (3) according to the present invention includes Si, Fe, Mn, Cu, and Zn as indispensable elements. Si, Fe, Mn, and Cu contribute to improvement in strength after brazing heating, and Zn contributes to improvement in the sacrificial anode effect.

First, the following is an explanation of composition of the aluminum alloy relating to the aluminum alloy fin material (1) according to the present invention.

The Si content of the aluminum alloy relating to the aluminum alloy fin material (1) according to the present invention is 0.05 mass % to 0.5 mass %, preferably 0.05 mass % to 0.4 mass %, and more preferably 0.05 mass % to 0.3 mass %. When the Si content is less than the range described above, the perimeter density of the second-phase grains or the solid solution quantity of the solute atoms becomes too small, and the strength after brazing heating does not increase. When the Si content exceeds the range described above, the melting point of the material becomes too low, and no proper brazability is secured.

The Fe content of the aluminum alloy relating to the aluminum alloy fin material (1) according to the present invention is 0.05 mass % to 0.7 mass %, preferably 0.05 mass % to 0.5 mass %, and more preferably 0.05 mass % to 0.3 mass %. When the Fe content is less than the range described above, the perimeter density of the second-phase grains or the solid solution quantity of the solute atoms becomes too small, and the strength after brazing heating does not increase. When the Fe content exceeds the range described above, recrystallized grains in brazing become minute, and no proper brazability is secured.

The Mn content of the aluminum alloy relating to the aluminum alloy fin material (1) according to the present invention is 1.0 mass % to 2.0 mass %, preferably 1.0 mass % to 1.8 mass %, and more preferably 1.0 mass % to 1.5 mass %. When the Mn content is less than the range described above, the perimeter density of the second-phase grains or the solid solution quantity of the solute atoms becomes too small, and the strength after brazing heating does not increase. When the Mn content exceeds the range described above, a coarse crystallized product is formed in casting, and the manufacturability deteriorates.

The Cu content of the aluminum alloy relating to the aluminum alloy fin material (1) according to the present invention is 0.5 mass % to 1.5 mass %, preferably 0.5 mass % to 1.3 mass %, and more preferably 0.5 mass % to 1.0 mass %. When the Cu content is less than the range described above, the perimeter density of the second-phase grains and the solid solution quantity of the solute atoms become too small, and the strength after brazing heating does not increase. When the Cu content exceeds the range described above, the melting point of the material becomes too low, and no proper brazability is secured.

The Zn content of the aluminum alloy relating to the aluminum alloy fin material (1) according to the present invention is 3.0 mass % to 7.0 mass %, preferably 3.0 mass % to 6.2 mass %, and more preferably 3.0 mass % to 5.0 mass %. When the Zn content is less than the range described above, no proper sacrificial anode effect is secured. When the Zn content exceeds the range described above, the corrosion speed increases, and no proper self-corrosion resistance is secured.

The following is an explanation of the composition of the aluminum alloy according to the aluminum alloy fin material (2) according to the present invention.

The Si content of the aluminum alloy relating to the aluminum alloy fin material (2) according to the present invention is 0.5 mass % to 1.0 mass %, preferably 0.5 mass % to 0.9 mass %, and more preferably 0.5 mass % to 0.8 mass %. When the Si content is the range described above, the perimeter density of the second-phase grains or the solid solution quantity of the solute atoms becomes too small, and the strength after brazing heating does not increase. When the Si content exceeds the range described above, the melting point of the material becomes too low, and no proper brazability is secured.

The Fe content of the aluminum alloy relating to the aluminum alloy fin material (2) according to the present invention is 0.05 mass % to 0.7 mass %, preferably 0.05 mass % to 0.5 mass %, and more preferably 0.05 mass % to 0.3 mass %. When the Fe content is less than the range described above, the perimeter density of the second-phase grains or the solid solution quantity of the solute atoms becomes too small, and the strength after brazing heating does not increase. When the Fe content exceeds the range described above, recrystallized grains in brazing become minute, and no proper brazability is secured.

The Mn content of the aluminum alloy relating to the aluminum alloy fin material (2) according to the present invention is 1.0 mass % to 2.0 mass %, preferably 1.0 mass % to 1.8 mass %, and more preferably 1.0 mass % to 1.5 mass %. When the Mn content is less than the range described above, the perimeter density of the second-phase grains or the solid solution quantity of the solute atoms becomes too small, and the strength after brazing heating does not increase. When the Mn content exceeds the range described above, a coarse crystallized product is formed in casting, and no proper manufacturability is secured.

The Cu content of the aluminum alloy relating to the aluminum alloy fin material (2) according to the present invention is 0.3 mass % to 1.2 mass %, preferably 0.3 mass % to 1.0 mass %, and more preferably 0.3 mass % to 0.8 mass %. When the Cu content is less than the range described above, the perimeter density of the second-phase grains and the solid solution quantity of the solute atoms become too small, and the strength after brazing heating does not increase. When the Cu content exceeds the range described above, the melting point of the material becomes too low, and no proper brazability is secured.

The Zn content of the aluminum alloy relating to the aluminum alloy fin material (2) according to the present invention is 2.2 mass % to 5.8 mass %, preferably 2.2 mass % to 5.0 mass %, and more preferably 2.2 mass % to 4.2 mass %. When the Zn content is less than the range described above, no proper sacrificial anode effect is secured. When the Zn content exceeds the range described above, the corrosion speed increases, and no proper self-corrosion resistance is secured.

The following is an explanation of the composition of the aluminum alloy relating to the aluminum alloy fin material (3) according to the present invention.

The Si content of the aluminum alloy relating to the aluminum alloy fin material (3) according to the present invention is 1.0 mass % to 1.5 mass %, preferably 1.0 mass % to 1.4 mass %, and more preferably 1.0 mass % to 1.3 mass %. When the Si content is the range described above, the perimeter density of the second-phase grains or the solid solution quantity of the solute atoms becomes too small, and the strength after brazing heating does not increase. When the Si content exceeds the range described above, the melting point of the material becomes too low, and no proper brazability is secured.

The Fe content of the aluminum alloy relating to the aluminum alloy fin material (3) according to the present invention is 0.05 mass % to 0.7 mass %, preferably 0.05 mass % to 0.5 mass %, and more preferably 0.05 mass % to 0.3 mass %. When the Fe content is less than the range described above, the perimeter density of the second-phase grains or the solid solution quantity of the solute atoms becomes too small, and the strength after brazing heating does not increase. When the Fe content exceeds the range described above, recrystallized grains in brazing become minute, and no proper brazability is secured.

The Mn content of the aluminum alloy relating to the aluminum alloy fin material (3) according to the present invention is 1.0 mass % to 2.0 mass %, preferably 1.0 mass % to 1.8 mass %, and more preferably 1.0 mass % to 1.5 mass %. When the Mn content is less than the range described above, the perimeter density of the second-phase grains or the solid solution quantity of the solute atoms becomes too small, and the strength after brazing heating does not increase. When the Mn content exceeds the range described above, a coarse crystallized product is formed in casting, and no proper manufacturability is secured.

The Cu content of the aluminum alloy relating to the aluminum alloy fin material (3) according to the present invention is 0.05 mass % to 0.5 mass %, preferably 0.05 mass % to 0.4 mass %, and more preferably 0.05 mass % to 0.3 mass %. When the Cu content is less than the range described above, the perimeter density of the second-phase grains and the solid solution quantity of the solute atoms become too small, and the strength after brazing heating does not increase. When the Cu content exceeds the range described above, the melting point of the material becomes too low, and no proper brazability is secured.

The Zn content of the aluminum alloy relating to the aluminum alloy fin material (3) according to the present invention is 0.5 mass % to 3.0 mass %, preferably 0.5 mass % to 2.6 mass %, and more preferably 0.5 mass % to 2.2 mass %. When the Zn content is less than the range described above, no proper sacrificial anode effect is secured. When the Zn content exceeds the range described above, the corrosion speed increases, and no proper self-corrosion resistance is secured.

Each of the aluminum alloy relating to the aluminum alloy fin material (1) according to the present invention, the aluminum alloy relating to the alumimun alloy fin material (2) according to the present invention, and the aluminum alloy relating to the aluminum alloy fin material (3) according to the present invention may further include at least one element selected from Ti, Zr, and Cr, as selective additional elements. Each of Ti, Zr, and Cr contributes to improvement in strength after brazing heating. Each of the Ti content, the Zr content, and the Cr content of each of the aluminum alloy relating to the aluminum alloy fin material (1) according to the present invention, the aluminum alloy relating to the aluminum alloy fin material (2) according to the present invention, and the aluminum alloy relating to the aluminum alloy fin material (3) according to the present invention is 0.05 mass % to 0.3 mass %, preferably 0.05 mass % to 0.2 mass %, and more preferably 0.05 mass % to 0.15 mass %. When each of the Ti content, the Zr content, and the Cr content is less than the range described above, no effect described above is acquired. When each of the Ti content, the Zr content, and the Cr content exceeds the range described above, a coarse crystallized product is formed in casting, and no proper manufacturability is secured.

The aluminum alloy fin material (1) according to the present invention, the aluminum alloy fin material (2) according to the present invention, and the aluminum alloy fin material (3) according to the present invention have similar metal structures.

The dispersion states of the second-phase grains of the aluminum alloy fin material (1) according to the present invention, the aluminum alloy fin material (2) according to the present invention, and the aluminum alloy fin material (3) according to the present invention contribute to improvement in strength after brazing heating, and are controlled with the chemical compositions, and the annealing temperature and the cold rolling shape ratio described later.

In the L-ST plane of each of the aluminum alloy fin material (1) according to the present invention, the aluminum alloy fin material (2) according to the present invention, and the aluminum alloy fin material (3) according to the present invention, the perimeter density of the second-phase grains having an equivalent circle diameter equal to or more than 0.030 μm and less than 0.50 μm is 0.30 $\mu m/\mu m^2$ or more, preferably 0.40 $\mu m/\mu m^2$ or more, and more preferably 0.50 $\mu m/\mu m^2$ or more, and the perimeter density of the second-phase grains having an equivalent circle diameter equal to or more than 0.50 μm have a perimeter density of 0.030 $\mu m/\mu m^2$ or more, preferably 0.040 $\mu m/\mu m^2$ or more, and more preferably 0.050 $\mu m/\mu m^2$ or more. When the perimeter density of the second-phase grains is less than the value described above, dislocations occurring during deformation hardly accumulate around the second-phase grains, increase in dislocation density becomes insufficient, and strength after brazing heating does not increase.

The solid solution quantity of the solute atoms contributes to improvement in strength after brazing heating, and is controlled with the chemical composition and the annealing temperature described later. The solid solution quantity of the solute atoms is correlated with the specific resistance. The specific resistance at 20° C. of each of the aluminum alloy fin material (1) according to the present invention, the aluminum alloy fin material (2) according to the present invention, and the aluminum alloy fin material (3) according to the present invention is 0.030 μm or more, preferably 0.031 μΩm or more, and more preferably 0.032 μΩm or more. When the specific resistance is less than the range described above, the solid solution quantity of the solute atoms becomes too small, and strength after brazing heating does not increase.

The melting point of each of the aluminum alloy fin material (1) according to the present invention, the aluminum alloy fin material (2) according to the present invention, and the aluminum alloy fin material (3) according to the present invention may be any temperature equal to or more than the brazing temperature, preferably 595° C. or more, particularly preferably 600° C. or more, and more preferably 605° C. or more. In addition, the tensile strength after brazing heating of the aluminum alloy fin material (1) according to the present invention, the aluminum alloy fin material (2) according to the present invention, and the aluminum alloy fin material (3) according to the present invention is 145 MPa or more, preferably 150 MPa or more, particularly preferably 155 MPa or more. In measurement of the tensile strength after brazing heating, first, the measurement samples were heated in a nitrogen-gas-atmosphere furnace, maintained at 590° C. for three minutes, thereafter cooled at cooling speed of 50° C./min, thereafter left at a room temperature for one week, to obtain tensile test samples. Thereafter, the obtained tensile test samples were subjected to a tensile test in accordance with JIS Z2241.

The following is an explanation of the method for manufacturing the aluminum alloy fin material (1) according to the present invention, the method for manufacturing the aluminum alloy fin material (2) according to the present invention, and the method for manufacturing the aluminum alloy fin material (3) according to the present invention. In the following explanation, the method for manufacturing the aluminum alloy fin material (1) according to the present invention, the method for manufacturing the aluminum alloy fin material (2) according to the present invention, and the method for manufacturing the aluminum alloy fin material (3) according to the present invention will be referred to as a method for manufacturing the aluminum alloy fin material for a heat exchanger according to the present invention, as a general name.

The method for manufacturing the aluminum alloy fin material for a heat exchanger according to the present invention is a method for manufacturing an aluminum alloy fin material for a heat exchanger, being one of the aluminum alloy fin material (1) according to the present invention, the aluminum alloy fin material (2) according to the present invention, and the aluminum alloy fin material (3) according to the present invention, comprising:

a casting step of acquiring a sheet-like ingot by a twin-roll type continuous casting rolling method; and a cold rolling step of subjecting the sheet-like ingot to cold rolling with at least one pass, to acquire an aluminum alloy fin material for a heat exchanger, wherein when L (mm) is a contact arc length between a roll and the material in cold rolling in the cold rolling step, H (mm) is half of sum of thicknesses on a roller inlet side and a roller outlet side, and L/H is a rolling shape ratio, a minimum value of the rolling shape ratio of each pass of cold rolling in the cold rolling step is 1.0 or more, at least one annealing is performed before a first pass, between a pass and another pass, or after a final pass in cold rolling in the cold rolling step, and a maximum achievable temperature of annealing performed at the highest temperature in the at least one annealing is 370° C. to 520° C.

In the method for manufacturing an aluminum alloy fin material for a heat exchanger according to the present invention, first, an Al metal and/or an Al-base master alloy is molten in a melting furnace, the composition of the molten metal is regulated to acquire the predetermined aluminum chemical composition, that is, the aluminum chemical composition relating to the aluminum alloy fin material (1) according to the present invention, the aluminum chemical composition relating to the aluminum alloy fin material (2) according to the present invention, or the aluminum chemical composition relating to the aluminum alloy fin material (3) according to the present invention, and the molten metal is casted to acquire an ingot. Thereafter, the acquired ingot is subjected to cold rolling with at least one pass, and subjected to annealing before the first pass of cold rolling, between passes, or after the final pass of cold rolling, to acquire an aluminum alloy fin material.

In addition, in the method for manufacturing an aluminum alloy fin material for a heat exchanger according to the present invention, the casting step is performed by the twin-roll type continuous casting rolling method, and the rolling shape ratio in the cold rolling step and the maximum achievable temperature in annealing performed before the first pass of cold rolling, between passes, or after the final pass is properly controlled to acquire the metal structure provided in the aluminum alloy fin material (1) according to the present invention, the aluminum alloy fin material (2) according to the present invention, and the aluminum alloy fin material (3) according to the present invention.

In the casting step according to the method for manufacturing an aluminum alloy fin material for a heat exchanger according to the present invention, the twin-roll type continuous casting rolling method is performed to acquire a sheet-like ingot having the aluminum chemical composition relating to the aluminum alloy fin material (1) according to the present invention, the aluminum chemical composition relating to the aluminum alloy fin material (2) according to the present invention, or the aluminum chemical composition relating to the aluminum alloy fin material (3) according to the present invention. The twin-roll type continuous casting rolling method is a method of supplying aluminum molten metal to a part between a pair of water-cooling rolls from a metal supply nozzle made of a fireproof material, and continuously casting and rolling a thin sheet. For example, Hunter method and 3C method are known as the twin-roll type continuous casting rolling method. The cooling speed in casting contributes to improvement in strength after brazing heating. In addition, in the twin-roll type continuous casting rolling method, the cooling speed in casting is several times to several hundred times as high as that of direct chill (DC) casting method and/or twin-belt type continuous casting method. For example, the cooling speed in the DC casting method is 0.5° C./sec to 20° C./sec, while the cooling speed in the twin-roll type continuous casting rolling method is 100° C./sec to 1,000° C./sec. For this reason, the twin-roll type continuous casting rolling method has a feature that the second-phase grains generated in casting are more finely and densely dispersed than in the DC casting method and/or the twin-belt type continuous casting rolling method. The second-phase grains dispersed with a high density have a high perimeter density, and contribute to improvement in strength after brazing heating.

The cold rolling step relating to the method for manufacturing the aluminum alloy fin material for a heat exchanger according to the present invention is a step of performing cold rolling on the sheet-like ingot acquired by performing the casting method. In the cold rolling step relating to the method for manufacturing the aluminum alloy fin material for a heat exchanger according to the present invention, the sheet-like ingot is subjected to cold rolling with at least one pass, and rolled to the final thickness.

The rolling shape ratio in the cold rolling contributes to improvement in strength after brazing heating. In addition, in the cold rolling step relating to the method for manufacturing the aluminum alloy fin material for a heat exchanger according to the present invention, the minimum value of the rolling shape ratio (L/H) of each pass of cold rolling is 1.0 or more, preferably 3.0 or more, and more preferably 5.0 or more. When the rolling shape ratio is less than the range described above, the shear force loaded on the sheet in rolling is insufficient, and the second-phase grains are not crushed. For this reason, the perimeter density of the second-phase grains becomes too low, and strength after brazing heating does not increase.

The rolling shape ratio "L/H" is a value of "L/H" when L (mm) is the contact arc length between the roll and the material in cold rolling in the cold rolling step and H (mm) is half of the sum of thicknesses on the roller inlet side and the roller outlet side.

The following is a method for calculating the rolling shape ratio L/H in the cold rolling step. When $h_1$ (mm) is the thickness on the roller inlet side in a pass, $h_2$ (mm) is the thickness on the roller outlet side in the pass, and R (mm) is the radius of the rolling roll, the contact arc length L (mm) between the rolling roll and the sheet can be approximated as "$L \approx [R \cdot (h_1 - h_2)]^{1/2}$", and the rolling shape ratio can be expressed with the following expression.

$$L/H \approx [R \cdot (h_1 - h_2)]^{1/2} / [h_1 + h_2]/2]$$

In the method for manufacturing the aluminum alloy fin material for a heat exchanger according to the present invention, at least one annealing is performed before the first pass, between passes, or the final pass in cold rolling in the cold rolling step, and the maximum achievable temperature of annealing performed at the highest temperature in the at least one annealing is 370° C. to 520° C., preferably 370° C. to 480° C., and more preferably 370° C. to 450° C. The maximum achievable temperature of annealing in which annealing is performed at the highest temperature contributes to improvement in strength after brazing heating. When the maximum achievable temperature is less than the range described above, the drive force of formation of the second-phase grains is too small, the perimeter density of the second-phase grains becomes too low, and strength after brazing heating does not increase. When the maximum achievable temperature exceeds the range described above, Ostwald ripening occurs in the second-phase grains, the perimeter density of the second-phase grains becomes too low, and strength after brazing heating does not increase. In addition, to secure proper rollability, the maximum achievable temperature of annealing is preferably 520° C. or less. When annealing is performed only once, the annealing temperature of the one annealing is regarded as the maximum achievable temperature of annealing in which annealing is performed at the highest temperature.

The following is a specific explanation of the present invention with examples illustrated, but the present invention is not limited to the examples illustrated hereinafter.

EXAMPLES

Examples and Comparative Examples

Alloys having the compositions listed in Table 1 to Table 3 were subjected to a twin-roll type continuous casting rolling method to acquire ingots with a thickness of 6 mm. Thereafter, the acquired sheet-like ingots were subjected to cold rolling with two to seven passes under the manufacturing conditions listed in Table 1 to Table 3, and thereafter subjected to annealing in a batch annealing furnace. Thereafter, the ingots were further subjected to cold rolling with two to seven passes to prepare aluminum alloy fin materials with a final thickness of 0.05 mm and temper designation H14.

Thereafter, the acquired aluminum alloy fin materials were used as samples and evaluated with respect to the perimeter density of the second-phase grains and the specific resistance before brazing heating, and the tensile strength after brazing heating, brazability, and corrosion resistance were evaluated. The measurement method and the evaluation method are as follows. Table 4 to Table 6 list results of the evaluation. The examples with the mark "x" in the item "manufacturability" in Table 1 to Table 3 are examples in which no samples could be manufactured, and could not be evaluated.

TABLE 1

| | | Chemical Composition (mass %) | | | | | | | Manufacturing Process | | |
|---|---|---|---|---|---|---|---|---|---|---|---|
| | No. | Si | Fe | Mn | Cu | Zn | Other Compositions | Al | Maximum Achievable Temperature (° C.) | Minimum Value of Rolling Shape Ratio | Manufacturability |
| Example | 1 | 0.05 | 0.3 | 1.5 | 1.0 | 5.0 | — | Balance | 450 | 5.0 | ○ |
| | 2 | 0.4 | 0.3 | 1.5 | 1.0 | 5.0 | — | Balance | 450 | 5.0 | ○ |
| | 3 | 0.5 | 0.3 | 1.5 | 1.0 | 5.0 | — | Balance | 450 | 5.0 | ○ |
| | 4 | 0.3 | 0.05 | 1.5 | 1.0 | 5.0 | — | Balance | 450 | 5.0 | ○ |
| | 5 | 0.3 | 0.5 | 1.5 | 1.0 | 5.0 | — | Balance | 450 | 5.0 | ○ |
| | 6 | 0.3 | 0.7 | 1.5 | 1.0 | 5.0 | — | Balance | 450 | 5.0 | ○ |
| | 7 | 0.3 | 0.3 | 1.0 | 1.0 | 5.0 | — | Balance | 450 | 5.0 | ○ |
| | 8 | 0.3 | 0.3 | 1.8 | 1.0 | 5.0 | — | Balance | 450 | 5.0 | ○ |
| | 9 | 0.3 | 0.3 | 2.0 | 1.0 | 5.0 | — | Balance | 450 | 5.0 | ○ |
| | 10 | 0.3 | 0.3 | 1.5 | 0.5 | 5.0 | — | Balance | 450 | 5.0 | ○ |
| | 11 | 0.3 | 0.3 | 1.5 | 1.3 | 5.0 | — | Balance | 450 | 5.0 | ○ |
| | 12 | 0.3 | 0.3 | 1.5 | 1.5 | 5.0 | — | Balance | 450 | 5.0 | ○ |
| | 13 | 0.3 | 0.3 | 1.5 | 1.0 | 3.0 | — | Balance | 450 | 5.0 | ○ |
| | 14 | 0.3 | 0.3 | 1.5 | 1.0 | 6.2 | — | Balance | 450 | 5.0 | ○ |
| | 15 | 0.3 | 0.3 | 1.5 | 1.0 | 7.0 | — | Balance | 450 | 5.0 | ○ |
| | 16 | 0.3 | 0.3 | 1.5 | 1.0 | 5.0 | Ti: 0.05 | Balance | 450 | 5.0 | ○ |
| | 17 | 0.3 | 0.3 | 1.5 | 1.0 | 5.0 | Ti: 0.15 | Balance | 450 | 5.0 | ○ |
| | 18 | 0.3 | 0.3 | 1.5 | 1.0 | 5.0 | Ti: 0.3 | Balance | 450 | 5.0 | ○ |
| | 19 | 0.3 | 0.3 | 1.5 | 1.0 | 5.0 | Zr: 0.05 | Balance | 450 | 5.0 | ○ |
| | 20 | 0.3 | 0.3 | 1.5 | 1.0 | 5.0 | Zr: 0.15 | Balance | 450 | 5.0 | ○ |
| | 21 | 0.3 | 0.3 | 1.5 | 1.0 | 5.0 | Zr: 0.3 | Balance | 450 | 5.0 | ○ |
| | 22 | 0.3 | 0.3 | 1.5 | 1.0 | 5.0 | Cr: 0.05 | Balance | 450 | 5.0 | ○ |
| | 23 | 0.3 | 0.3 | 1.5 | 1.0 | 5.0 | Cr: 0.15 | Balance | 450 | 5.0 | ○ |
| | 24 | 0.3 | 0.3 | 1.5 | 1.0 | 5.0 | Cr: 0.3 | Balance | 450 | 5.0 | ○ |
| | 25 | 0.3 | 0.3 | 1.5 | 1.0 | 5.0 | — | Balance | 370 | 5.0 | ○ |
| | 26 | 0.3 | 0.3 | 1.5 | 1.0 | 5.0 | — | Balance | 480 | 5.0 | ○ |
| | 27 | 0.3 | 0.3 | 1.5 | 1.0 | 5.0 | — | Balance | 520 | 5.0 | ○ |
| | 28 | 0.3 | 0.3 | 1.5 | 1.0 | 5.0 | — | Balance | 450 | 1.0 | ○ |
| | 29 | 0.3 | 0.3 | 1.5 | 1.0 | 5.0 | — | Balance | 450 | 3.0 | ○ |
| | 30 | 0.5 | 0.3 | 1.5 | 0.8 | 4.2 | — | Balance | 450 | 5.0 | ○ |
| | 31 | 0.9 | 0.3 | 1.5 | 0.8 | 4.2 | — | Balance | 450 | 5.0 | ○ |
| | 32 | 1.0 | 0.3 | 1.5 | 0.8 | 4.2 | — | Balance | 450 | 5.0 | ○ |
| | 33 | 0.8 | 0.05 | 1.5 | 0.8 | 4.2 | — | Balance | 450 | 5.0 | ○ |
| | 34 | 0.8 | 0.5 | 1.5 | 0.8 | 4.2 | — | Balance | 450 | 5.0 | ○ |
| | 35 | 0.8 | 0.7 | 1.5 | 0.8 | 4.2 | — | Balance | 450 | 5.0 | ○ |
| | 36 | 0.8 | 0.3 | 1.0 | 0.8 | 4.2 | — | Balance | 450 | 5.0 | ○ |
| | 37 | 0.8 | 0.3 | 1.8 | 0.8 | 4.2 | — | Balance | 450 | 5.0 | ○ |
| | 38 | 0.8 | 0.3 | 2.0 | 0.8 | 4.2 | — | Balance | 450 | 5.0 | ○ |
| | 39 | 0.8 | 0.3 | 1.5 | 0.3 | 4.2 | — | Balance | 450 | 5.0 | ○ |
| | 40 | 0.8 | 0.3 | 1.5 | 1.0 | 4.2 | — | Balance | 450 | 5.0 | ○ |
| | 41 | 0.8 | 0.3 | 1.5 | 1.2 | 4.2 | — | Balance | 450 | 5.0 | ○ |
| | 42 | 0.8 | 0.3 | 1.5 | 0.8 | 2.2 | — | Balance | 450 | 5.0 | ○ |
| | 43 | 0.8 | 0.3 | 1.5 | 0.8 | 5.0 | — | Balance | 450 | 5.0 | ○ |
| | 44 | 0.8 | 0.3 | 1.5 | 0.8 | 5.8 | — | Balance | 450 | 5.0 | ○ |

TABLE 1-continued

| | Chemical Composition (mass %) | | | | | | | Manufacturing Process | | |
|---|---|---|---|---|---|---|---|---|---|---|
| No. | Si | Fe | Mn | Cu | Zn | Other Compositions | Al | Maximum Achievable Temperature (° C.) | Minimum Value of Rolling Shape Ratio | Manufacturability |
| 45 | 0.8 | 0.3 | 1.5 | 0.8 | 4.2 | Ti: 0.05 | Balance | 450 | 5.0 | ○ |
| 46 | 0.8 | 0.3 | 1.5 | 0.8 | 4.2 | Ti: 0.15 | Balance | 450 | 5.0 | ○ |
| 47 | 0.8 | 0.3 | 1.5 | 0.8 | 4.2 | Ti: 0.3 | Balance | 450 | 5.0 | ○ |

TABLE 2

| | | Chemical Composition (mass %) | | | | | | | Manufacturing Process | | |
|---|---|---|---|---|---|---|---|---|---|---|---|
| | No. | Si | Fe | Mn | Cu | Zn | Other Compositions | Al | Maximum Achievable Temperature (° C.) | Minimum Value of Rolling Shape Ratio | Manufacturability |
| Example | 48 | 0.8 | 0.3 | 1.5 | 0.8 | 4.2 | Zr: 0.05 | Balance | 450 | 5.0 | ○ |
| | 49 | 0.8 | 0.3 | 1.5 | 0.8 | 4.2 | Zr: 0.15 | Balance | 450 | 5.0 | ○ |
| | 50 | 0.8 | 0.3 | 1.5 | 0.8 | 4.2 | Zr: 0.3 | Balance | 450 | 5.0 | ○ |
| | 51 | 0.8 | 0.3 | 1.5 | 0.8 | 4.2 | Cr: 0.05 | Balance | 450 | 5.0 | ○ |
| | 52 | 0.8 | 0.3 | 1.5 | 0.8 | 4.2 | Cr: 0.15 | Balance | 450 | 5.0 | ○ |
| | 53 | 0.8 | 0.3 | 1.5 | 0.8 | 4.2 | Cr: 0.3 | Balance | 450 | 5.0 | ○ |
| | 54 | 0.8 | 0.3 | 1.5 | 0.8 | 4.2 | — | Balance | 370 | 5.0 | ○ |
| | 55 | 0.8 | 0.3 | 1.5 | 0.8 | 4.2 | — | Balance | 480 | 5.0 | ○ |
| | 56 | 0.8 | 0.3 | 1.5 | 0.8 | 4.2 | — | Balance | 520 | 5.0 | ○ |
| | 57 | 0.8 | 0.3 | 1.5 | 0.8 | 4.2 | — | Balance | 450 | 1.0 | ○ |
| | 58 | 0.8 | 0.3 | 1.5 | 0.8 | 4.2 | — | Balance | 450 | 3.0 | ○ |
| | 59 | 1.0 | 0.3 | 1.5 | 0.3 | 2.2 | — | Balance | 450 | 5.0 | ○ |
| | 60 | 1.4 | 0.3 | 1.5 | 0.3 | 2.2 | — | Balance | 450 | 5.0 | ○ |
| | 61 | 1.5 | 0.3 | 1.5 | 0.3 | 2.2 | — | Balance | 450 | 5.0 | ○ |
| | 62 | 1.3 | 0.05 | 1.5 | 0.3 | 2.2 | — | Balance | 450 | 5.0 | ○ |
| | 63 | 1.3 | 0.5 | 1.5 | 0.3 | 2.2 | — | Balance | 450 | 5.0 | ○ |
| | 64 | 1.3 | 0.7 | 1.5 | 0.3 | 2.2 | — | Balance | 450 | 5.0 | ○ |
| | 65 | 1.3 | 0.3 | 1.0 | 0.3 | 2.2 | — | Balance | 450 | 5.0 | ○ |
| | 66 | 1.3 | 0.3 | 1.8 | 0.3 | 2.2 | — | Balance | 450 | 5.0 | ○ |
| | 67 | 1.3 | 0.3 | 2.0 | 0.3 | 2.2 | — | Balance | 450 | 5.0 | ○ |
| | 68 | 1.3 | 0.3 | 1.5 | 0.05 | 2.2 | — | Balance | 450 | 5.0 | ○ |
| | 69 | 1.3 | 0.3 | 1.5 | 0.4 | 2.2 | — | Balance | 450 | 5.0 | ○ |
| | 70 | 1.3 | 0.3 | 1.5 | 0.5 | 2.2 | — | Balance | 450 | 5.0 | ○ |
| | 71 | 1.3 | 0.3 | 1.5 | 0.3 | 0.5 | — | Balance | 450 | 5.0 | ○ |
| | 72 | 1.3 | 0.3 | 1.5 | 0.3 | 2.6 | — | Balance | 450 | 5.0 | ○ |
| | 73 | 1.3 | 0.3 | 1.5 | 0.3 | 3.0 | — | Balance | 450 | 5.0 | ○ |
| | 74 | 1.3 | 0.3 | 1.5 | 0.3 | 2.2 | Ti: 0.05 | Balance | 450 | 5.0 | ○ |
| | 75 | 1.3 | 0.3 | 1.5 | 0.3 | 2.2 | Ti: 0.15 | Balance | 450 | 5.0 | ○ |
| | 76 | 1.3 | 0.3 | 1.5 | 0.3 | 2.2 | Ti: 0.3 | Balance | 450 | 5.0 | ○ |
| | 77 | 1.3 | 0.3 | 1.5 | 0.3 | 2.2 | Zr: 0.05 | Balance | 450 | 5.0 | ○ |
| | 78 | 1.3 | 0.3 | 1.5 | 0.3 | 2.2 | Zr: 0.15 | Balance | 450 | 5.0 | ○ |
| | 79 | 1.3 | 0.3 | 1.5 | 0.3 | 2.2 | Zr: 0.3 | Balance | 450 | 5.0 | ○ |
| | 80 | 1.3 | 0.3 | 1.5 | 0.3 | 2.2 | Cr: 0.05 | Balance | 450 | 5.0 | ○ |
| | 81 | 1.3 | 0.3 | 1.5 | 0.3 | 2.2 | Cr: 0.15 | Balance | 450 | 5.0 | ○ |
| | 82 | 1.3 | 0.3 | 1.5 | 0.3 | 2.2 | Cr: 0.3 | Balance | 450 | 5.0 | ○ |
| | 83 | 1.3 | 0.3 | 1.5 | 0.3 | 2.2 | — | Balance | 370 | 5.0 | ○ |
| | 84 | 1.3 | 0.3 | 1.5 | 0.3 | 2.2 | — | Balance | 480 | 5.0 | ○ |
| | 85 | 1.3 | 0.3 | 1.5 | 0.3 | 2.2 | — | Balance | 520 | 5.0 | ○ |
| | 86 | 1.3 | 0.3 | 1.5 | 0.3 | 2.2 | — | Balance | 450 | 1.0 | ○ |
| | 87 | 1.3 | 0.3 | 1.5 | 0.3 | 2.2 | — | Balance | 450 | 3.0 | ○ |

TABLE 3

| | | Chemical Composition (mass %) | | | | | | | Manufacturing Process | | |
|---|---|---|---|---|---|---|---|---|---|---|---|
| | No. | Si | Fe | Mn | Cu | Zn | Other Compositions | Al | Maximum Achievable Temperature (° C.) | Minimum Value of Rolling Shape Ratio | Manufacturability |
| Comparative Example | 1 | 0.3 | 0.01 | 1.5 | 1.0 | 5.0 | — | Balance | 450 | 5.0 | ○ |
| | 2 | 0.3 | 1.0 | 1.5 | 1.0 | 5.0 | — | Balance | 450 | 5.0 | ○ |
| | 3 | 0.3 | 0.3 | 0.8 | 1.0 | 5.0 | — | Balance | 450 | 5.0 | ○ |
| | 4 | 0.3 | 0.3 | 2.2 | 1.0 | 5.0 | — | Balance | 450 | 5.0 | X |
| | 5 | 0.05 | 0.3 | 1.5 | 1.7 | 7.8 | — | Balance | 450 | 5.0 | ○ |
| | 6 | 0.4 | 0.3 | 1.5 | 0.4 | 2.6 | — | Balance | 450 | 5.0 | ○ |
| | 7 | 0.3 | 0.3 | 1.5 | 1.0 | 5.0 | Ti: 0.4 | Balance | 450 | 5.0 | X |
| | 8 | 0.3 | 0.3 | 1.5 | 1.0 | 5.0 | Zr: 0.4 | Balance | 450 | 5.0 | X |
| | 9 | 0.3 | 0.3 | 1.5 | 1.0 | 5.0 | Cr: 0.4 | Balance | 450 | 5.0 | X |
| | 10 | 0.3 | 0.3 | 1.5 | 1.0 | 5.0 | — | Balance | 350 | 5.0 | ○ |
| | 11 | 0.3 | 0.3 | 1.5 | 1.0 | 5.0 | — | Balance | 540 | 5.0 | ○ |
| | 12 | 0.3 | 0.3 | 1.5 | 1.0 | 5.0 | — | Balance | 450 | 0.8 | ○ |
| | 13 | 0.8 | 0.01 | 1.5 | 0.8 | 4.2 | — | Balance | 450 | 5.0 | ○ |
| | 14 | 0.8 | 1.0 | 1.5 | 0.8 | 4.2 | — | Balance | 450 | 5.0 | ○ |
| | 15 | 0.8 | 0.3 | 0.8 | 0.8 | 4.2 | — | Balance | 450 | 5.0 | ○ |
| | 16 | 0.8 | 0.3 | 2.2 | 0.8 | 4.2 | — | Balance | 450 | 5.0 | X |
| | 17 | 0.6 | 0.3 | 1.5 | 1.3 | 6.2 | — | Balance | 450 | 5.0 | ○ |
| | 18 | 0.9 | 0.3 | 1.5 | 0.2 | 1.8 | — | Balance | 450 | 5.0 | ○ |
| | 19 | 0.8 | 0.3 | 1.5 | 0.8 | 4.2 | Ti: 0.4 | Balance | 450 | 5.0 | X |
| | 20 | 0.8 | 0.3 | 1.5 | 0.8 | 4.2 | Zr: 0.4 | Balance | 450 | 5.0 | X |
| | 21 | 0.8 | 0.3 | 1.5 | 0.8 | 4.2 | Cr: 0.4 | Balance | 450 | 5.0 | X |
| | 22 | 0.8 | 0.3 | 1.5 | 0.8 | 4.2 | — | Balance | 350 | 5.0 | ○ |
| | 23 | 0.8 | 0.3 | 1.5 | 0.8 | 4.2 | — | Balance | 540 | 5.0 | ○ |
| | 24 | 0.8 | 0.3 | 1.5 | 0.8 | 4.2 | — | Balance | 450 | 0.8 | ○ |
| | 25 | 1.3 | 0.01 | 1.5 | 0.3 | 2.2 | — | Balance | 450 | 5.0 | ○ |
| | 26 | 1.3 | 1.0 | 1.5 | 0.3 | 2.2 | — | Balance | 450 | 5.0 | ○ |
| | 27 | 1.3 | 0.3 | 0.8 | 0.3 | 2.2 | — | Balance | 450 | 5.0 | ○ |
| | 28 | 1.3 | 0.3 | 2.2 | 0.3 | 2.2 | — | Balance | 450 | 5.0 | X |
| | 29 | 1.2 | 0.3 | 1.5 | 0.7 | 3.8 | — | Balance | 450 | 5.0 | ○ |
| | 30 | 1.6 | 0.3 | 1.5 | 0.05 | 1.0 | — | Balance | 450 | 5.0 | ○ |
| | 31 | 1.3 | 0.3 | 1.5 | 0.3 | 2.2 | Ti: 0.4 | Balance | 450 | 5.0 | X |
| | 32 | 1.3 | 0.3 | 1.5 | 0.3 | 2.2 | Zr: 0.4 | Balance | 450 | 5.0 | X |
| | 33 | 1.3 | 0.3 | 1.5 | 0.3 | 2.2 | Cr: 0.4 | Balance | 450 | 5.0 | X |
| | 34 | 1.3 | 0.3 | 1.5 | 0.3 | 2.2 | — | Balance | 350 | 5.0 | ○ |
| | 35 | 1.3 | 0.3 | 1.5 | 0.3 | 2.2 | — | Balance | 540 | 5.0 | ○ |
| | 36 | 1.3 | 0.3 | 1.5 | 0.3 | 2.2 | — | Balance | 450 | 0.8 | ○ |

In the chemical composition tables of Table 1 to Table 3, the mark "-" means that the content was less than the detection limit of the spark discharge optical emission spectrometer, and the term "balance" means that the balance is formed of Al and unavoidable impurities. The term "maximum achievable temperature" in the manufacturing process indicates the maximum achievable temperature of annealing, and the term "minimum value of the rolling shape ratio" indicates the minimum value of the rolling shape ratio of cold rolling.

Perimeter Density of Second-phase Grains

An L-ST plane (plane including the rolling direction and the thickness direction) in the center of the thickness of each of the samples was imaged with a field emission scanning electron microscope (FE-SEM) with 20,000 magnifications, the perimeter (μm) for second-phase grains with an equivalent circle diameter equal to or more than 0.030 μm and less than 0.50 μm was measured with image analysis software, and the sum of the perimeters was divided by the imaging area to calculate the perimeter density. In the same manner, the L-ST plane in the center of the thickness was imaged with a field emission scanning electron microscope (FE-SEM) with 3,000 magnifications, the perimeter (μm) for second-phase grains with an equivalent circle diameter equal to or more than 0.50 μm was measured with image analysis software, and the sum of the perimeters was divided by the imaging area to calculate the perimeter density. The perimeter density was calculated with five fields of view for the same sample, and the arithmetic mean value of the values was calculated as the perimeter density.

Specific Resistance

In accordance with JIS-H0505, the electrical resistance of each of the samples was measured in a thermostatic chamber at 20° C. to calculate the specific resistance.

Strength after Brazing Heating

Each of the samples was subjected to brazing heating, thereafter cooled at cooling speed of 50° C./min, and thereafter left at a room temperature for one week, to acquire samples. Brazing heating was performed by heating each of the samples in a nitrogen-gas-atmosphere furnace, and maintained at 590° C. for three minutes. Each of the samples was subjected to tensile test in accordance with JIS Z2241. The samples with the tensile strength of 145 MPa or more were expressed with the symbol "O".

Brazability

Miniature cores of a heat exchanger were prepared by corrugating the individual fin materials, assembling the individual fin materials with a tube formed of a sheet material formed in a flat shape, having a thickness of 0.20 mm, and formed of a core material of JIS-A3003 alloy and a brazing material of JIS-A4045 alloy, applying a fluoride-based flux with a concentration of 3% onto the brazing-material side surface of the tube material, and performing brazing heating in a nitrogen-gas atmosphere at 590° C. for three minutes. With respect to each of the miniature cores, brazability was evaluated on the basis of presence/absence of buckling and melting of the fin, by observing the bonded portion between the fin material and the tube material by visual inspection. The symbol "O" indicates the case where neither buckling nor melting occurred, and the symbol "x" indicates the case where buckling or melting occurred.

Corrosion Resistance

Miniature cores prepared in the same manner as the miniature cores for evaluating brazability were subjected to corrosion test conforming to copper accelerated acetic acid salt spray (CASS) test of JIS-H8681 for two weeks. Evaluation was performed on the corrosion state on the brazing material side of the tube and the corrosion state of the fin after the test. The symbol "O" indicates the case where no through hole was generated in the tube, and the symbol "x" indicates the case where a through hole was generated in the tube. The symbol "O" indicates the case with small self-corrosion of the fin, and the symbol "x" indicates the case with large self-corrosion of the fin.

TABLE 4

| | | Metal Structure Before Brazing Heating | | | | Properties After Brazing Heating | |
|---|---|---|---|---|---|---|---|
| | No. | Perimeter Density of Second-Phase Grains with Equivalent Circle Diameter Equal to or More Than 0.030 μm and Less Than 0.50 μm | Perimeter Density of Second-Phase Grains with Equivalent Circle Diameter Equal to or More Than 0.50 μm (μm/μm$^2$) | Specific Resistance (μΩm) | Tensile Strength (MPa) | Brazability | Corrosion Resistance |
| Example | 1 | 0.40 | 0.100 | 0.036 | 149 | ○ | ○ |
| | 2 | 1.10 | 0.102 | 0.035 | 163 | ○ | ○ |
| | 3 | 1.17 | 0.105 | 0.034 | 165 | ○ | ○ |
| | 4 | 1.16 | 0.039 | 0.036 | 157 | ○ | ○ |
| | 5 | 0.63 | 0.109 | 0.035 | 160 | ○ | ○ |
| | 6 | 0.37 | 0.115 | 0.034 | 159 | ○ | ○ |
| | 7 | 0.43 | 0.041 | 0.033 | 151 | ○ | ○ |
| | 8 | 1.05 | 0.113 | 0.035 | 162 | ○ | ○ |
| | 9 | 1.24 | 0.116 | 0.036 | 165 | ○ | ○ |
| | 10 | 0.36 | 0.096 | 0.033 | 149 | ○ | ○ |
| | 11 | 1.15 | 0.105 | 0.035 | 164 | ○ | ○ |
| | 12 | 1.19 | 0.096 | 0.036 | 164 | ○ | ○ |
| | 13 | 1.00 | 0.096 | 0.032 | 159 | ○ | ○ |
| | 14 | 1.03 | 0.097 | 0.036 | 159 | ○ | ○ |
| | 15 | 1.00 | 0.097 | 0.037 | 160 | ○ | ○ |
| | 16 | 1.01 | 0.102 | 0.035 | 161 | ○ | ○ |
| | 17 | 1.01 | 0.096 | 0.035 | 162 | ○ | ○ |
| | 18 | 0.95 | 0.097 | 0.035 | 163 | ○ | ○ |
| | 19 | 0.96 | 0.099 | 0.035 | 161 | ○ | ○ |
| | 20 | 1.00 | 0.102 | 0.035 | 162 | ○ | ○ |
| | 21 | 0.95 | 0.105 | 0.035 | 163 | ○ | ○ |
| | 22 | 1.00 | 0.103 | 0.035 | 161 | ○ | ○ |
| | 23 | 0.98 | 0.099 | 0.035 | 162 | ○ | ○ |
| | 24 | 1.02 | 0.102 | 0.035 | 163 | ○ | ○ |
| | 25 | 0.38 | 0.057 | 0.036 | 151 | ○ | ○ |
| | 26 | 0.73 | 0.081 | 0.035 | 156 | ○ | ○ |
| | 27 | 0.36 | 0.062 | 0.036 | 150 | ○ | ○ |
| | 28 | 0.43 | 0.035 | 0.035 | 148 | ○ | ○ |
| | 29 | 0.75 | 0.072 | 0.035 | 155 | ○ | ○ |
| | 30 | 0.39 | 0.097 | 0.035 | 148 | ○ | ○ |
| | 31 | 1.05 | 0.099 | 0.034 | 164 | ○ | ○ |
| | 32 | 1.16 | 0.102 | 0.033 | 166 | ○ | ○ |
| | 33 | 1.24 | 0.042 | 0.035 | 158 | ○ | ○ |
| | 34 | 0.55 | 0.112 | 0.034 | 161 | ○ | ○ |
| | 35 | 0.38 | 0.115 | 0.033 | 161 | ○ | ○ |
| | 36 | 0.39 | 0.044 | 0.032 | 149 | ○ | ○ |
| | 37 | 1.13 | 0.115 | 0.034 | 163 | ○ | ○ |
| | 38 | 1.19 | 0.118 | 0.035 | 166 | ○ | ○ |
| | 39 | 0.43 | 0.096 | 0.032 | 148 | ○ | ○ |
| | 40 | 1.13 | 0.098 | 0.034 | 164 | ○ | ○ |
| | 41 | 1.18 | 0.098 | 0.035 | 164 | ○ | ○ |
| | 42 | 1.02 | 0.096 | 0.031 | 161 | ○ | ○ |
| | 43 | 1.01 | 0.101 | 0.035 | 159 | ○ | ○ |
| | 44 | 0.96 | 0.099 | 0.036 | 160 | ○ | ○ |
| | 45 | 1.03 | 0.101 | 0.034 | 161 | ○ | ○ |
| | 46 | 0.96 | 0.104 | 0.034 | 162 | ○ | ○ |
| | 47 | 1.04 | 0.102 | 0.034 | 163 | ○ | ○ |

TABLE 5

| | | Metal Structure Before Brazing Heating | | | Properties After Brazing Heating | | |
|---|---|---|---|---|---|---|---|
| | No. | Perimeter Density of Second-Phase Grains with Equivalent Circle Diameter Equal to or More Than 0.030 μm and Less Than 0.50 μm (μm/μm$^2$) | Perimeter Density of Second-Phase Grains with Equivalent Circle Diameter Equal to or More Than 0.50 μm (μm/μm$^2$) | Specific Resistance (μΩm) | Tensile Strength (MPa) | Brazability | Corrosion Resistance |
| Example | 48 | 0.97 | 0.105 | 0.034 | 161 | ○ | ○ |
| | 49 | 0.96 | 0.102 | 0.034 | 162 | ○ | ○ |
| | 50 | 0.99 | 0.096 | 0.034 | 163 | ○ | ○ |
| | 51 | 0.98 | 0.097 | 0.034 | 161 | ○ | ○ |
| | 52 | 0.97 | 0.099 | 0.034 | 162 | ○ | ○ |
| | 53 | 1.03 | 0.102 | 0.034 | 163 | ○ | ○ |
| | 54 | 0.43 | 0.064 | 0.035 | 148 | ○ | ○ |
| | 55 | 0.71 | 0.085 | 0.034 | 155 | ○ | ○ |
| | 56 | 0.40 | 0.062 | 0.035 | 152 | ○ | ○ |
| | 57 | 0.37 | 0.039 | 0.034 | 151 | ○ | ○ |
| | 58 | 0.66 | 0.067 | 0.034 | 154 | ○ | ○ |
| | 59 | 0.44 | 0.095 | 0.034 | 151 | ○ | ○ |
| | 60 | 1.05 | 0.102 | 0.033 | 163 | ○ | ○ |
| | 61 | 1.23 | 0.104 | 0.032 | 165 | ○ | ○ |
| | 62 | 1.16 | 0.043 | 0.034 | 156 | ○ | ○ |
| | 63 | 0.65 | 0.109 | 0.033 | 159 | ○ | ○ |
| | 64 | 0.44 | 0.122 | 0.032 | 160 | ○ | ○ |
| | 65 | 0.45 | 0.040 | 0.031 | 152 | ○ | ○ |
| | 66 | 1.14 | 0.105 | 0.033 | 162 | ○ | ○ |
| | 67 | 1.19 | 0.121 | 0.034 | 164 | ○ | ○ |
| | 68 | 0.43 | 0.099 | 0.031 | 150 | ○ | ○ |
| | 69 | 1.14 | 0.102 | 0.033 | 164 | ○ | ○ |
| | 70 | 1.22 | 0.100 | 0.034 | 165 | ○ | ○ |
| | 71 | 0.96 | 0.102 | 0.030 | 161 | ○ | ○ |
| | 72 | 0.96 | 0.099 | 0.034 | 160 | ○ | ○ |
| | 73 | 1.05 | 0.103 | 0.035 | 160 | ○ | ○ |
| | 74 | 0.98 | 0.101 | 0.033 | 161 | ○ | ○ |
| | 75 | 1.03 | 0.095 | 0.033 | 162 | ○ | ○ |
| | 76 | 1.02 | 0.101 | 0.033 | 163 | ○ | ○ |
| | 77 | 1.05 | 0.103 | 0.033 | 161 | ○ | ○ |
| | 78 | 0.99 | 0.099 | 0.033 | 162 | ○ | ○ |
| | 79 | 0.97 | 0.098 | 0.033 | 163 | ○ | ○ |
| | 80 | 1.04 | 0.096 | 0.033 | 161 | ○ | ○ |
| | 81 | 1.00 | 0.102 | 0.033 | 162 | ○ | ○ |
| | 82 | 0.99 | 0.100 | 0.033 | 163 | ○ | ○ |
| | 83 | 0.35 | 0.062 | 0.034 | 149 | ○ | ○ |
| | 84 | 0.70 | 0.084 | 0.033 | 155 | ○ | ○ |
| | 85 | 0.39 | 0.060 | 0.034 | 150 | ○ | ○ |
| | 86 | 0.35 | 0.035 | 0.033 | 150 | ○ | ○ |
| | 87 | 0.72 | 0.069 | 0.033 | 154 | ○ | ○ |

TABLE 6

| | | Metal Structure Before Brazing Heating | | | Properties After Brazing Heating | | |
|---|---|---|---|---|---|---|---|
| | No. | Perimeter Density of Second-Phase Grains with Equivalent Circle Diameter Equal to or More Than 0.030 μm and Less Than 0.50 μm (μm/μm$^2$) | Perimeter Density of Second-Phase Grains with Equivalent Circle Diameter Equal to or More Than 0.50 μm (μm/μm$^2$) | Specific Resistance (μΩm) | Tensile Strength (MPa) | Brazability | Corrosion Resistance |
| Comparative Example | 1 | 1.30 | 0.029 | 0.036 | 141 | ○ | ○ |
| | 2 | 0.31 | 0.125 | 0.033 | 161 | X | ○ |
| | 3 | 0.29 | 0.026 | 0.032 | 144 | ○ | ○ |
| | 4 | — | — | — | — | — | — |
| | 5 | 1.03 | 0.097 | 0.038 | 161 | X | X |
| | 6 | 0.29 | 0.098 | 0.029 | 143 | ○ | X |
| | 7 | — | — | — | — | — | — |
| | 8 | — | — | — | — | — | — |
| | 9 | — | — | — | — | — | — |

TABLE 6-continued

| | Metal Structure Before Brazing Heating | | | | Properties After Brazing Heating | |
|---|---|---|---|---|---|---|
| No. | Perimeter Density of Second-Phase Grains with Equivalent Circle Diameter Equal to or More Than 0.030 μm and Less Than 0.50 μm (μm/μm²) | Perimeter Density of Second-Phase Grains with Equivalent Circle Diameter Equal to or More Than 0.50 μm (μm/μm²) | Specific Resistance (μΩm) | Tensile Strength (MPa) | Brazability | Corrosion Resistance |
| 10 | 0.29 | 0.096 | 0.037 | 143 | ○ | ○ |
| 11 | 0.27 | 0.099 | 0.037 | 140 | ○ | ○ |
| 12 | 0.25 | 0.026 | 0.035 | 144 | ○ | ○ |
| 13 | 1.33 | 0.025 | 0.035 | 140 | ○ | ○ |
| 14 | 0.32 | 0.125 | 0.032 | 159 | X | ○ |
| 15 | 0.28 | 0.029 | 0.031 | 143 | ○ | ○ |
| 16 | — | — | — | — | — | — |
| 17 | 1.05 | 0.099 | 0.037 | 159 | X | X |
| 18 | 0.26 | 0.104 | 0.029 | 140 | ○ | X |
| 19 | — | — | — | — | — | — |
| 20 | — | — | — | — | — | — |
| 21 | — | — | — | — | — | — |
| 22 | 0.28 | 0.103 | 0.036 | 140 | ○ | ○ |
| 23 | 0.26 | 0.101 | 0.036 | 144 | ○ | ○ |
| 24 | 0.27 | 0.029 | 0.034 | 143 | ○ | ○ |
| 25 | 1.30 | 0.025 | 0.034 | 142 | ○ | ○ |
| 26 | 0.31 | 0.134 | 0.031 | 159 | X | ○ |
| 27 | 0.29 | 0.025 | 0.030 | 140 | ○ | ○ |
| 28 | — | — | — | — | — | — |
| 29 | 1.04 | 0.096 | 0.036 | 160 | X | X |
| 30 | 0.29 | 0.103 | 0.029 | 141 | ○ | ○ |
| 31 | — | — | — | — | — | — |
| 32 | — | — | — | — | — | — |
| 33 | — | — | — | — | — | — |
| 34 | 0.28 | 0.097 | 0.030 | 142 | ○ | ○ |
| 35 | 0.28 | 0.105 | 0.030 | 142 | ○ | ○ |
| 36 | 0.28 | 0.026 | 0.033 | 143 | ○ | ○ |

In Examples 1 to 87, the chemical compositions fall within the range provided in the present invention, and the manufacturing conditions thereof satisfy the conditions provided in the present invention. These examples of the present invention exhibited good manufacturability, and had metal structures satisfying the conditions provided in the present invention. In addition, these examples of the present invention passed the test in each of strength after brazing heating, brazability, and corrosion resistance.

In Comparative Examples 1 to 9, the chemical compositions fell out of the range provided in the present invention, and the following results were obtained.

In Comparative Example 1, the Fe content was too low, and the perimeter density of the second-phase grains was too low. For this reason, Comparative Example 1 failed in strength after brazing heating.

In Comparative Example 2, the Fe content was too high, and the grain size after brazing heating was minute. For this reason, Comparative Example 2 failed in brazability.

In Comparative Example 3, the Mn content was too low, and the perimeter density of the second-phase grains was too low. For this reason, Comparative Example 3 failed in strength after brazing heating.

In Comparative Example 4, the Mn content was too high, cracks occurred during cold rolling, and no fin material could be manufactured.

In Comparative Example 5, the Cu content and the Zn content were too high, and the melting point of the material was low. For this reason, Comparative Example 5 failed in brazability. In addition, because the self-corrosion speed increased, Comparative Example 5 failed in corrosion resistance.

In Comparative Example 6, the Cu content and the Zn content were too low, and the perimeter density of the second-phase grains and the specific resistance were too low. For this reason, Comparative Example 6 failed in strength after brazing heating. In addition, because it had a noble spontaneous potential, Comparative Example 6 failed in corrosion resistance.

Comparative Examples 7 included an excessive Ti content, Comparative Example 8 included an excessive Zr content, and Comparative Example 9 included an excessive Cr content. For this reason, in Comparative Examples 7 to 9, cracks occurred during cold rolling, and no fin materials could be manufactured.

Comparative Examples 10 to 12 included the manufacturing conditions falling out of the conditions provided in the present invention, and produced the following results.

In Comparative Example 10, the maximum achievable temperature of annealing in which annealing was performed at the highest temperature was too low, and the perimeter density of the second-phase grains was too low. For this reason, Comparative Example 10 failed in strength after brazing heating.

In Comparative Example 11, the maximum achievable temperature of annealing in which annealing was performed at the highest temperature was too high, and the perimeter density of the second-phase grains was too low. For this reason, Comparative Example 11 failed in strength after brazing heating.

In Comparative Example 12, the minimum value of the rolling shape ratio in the cold rolling step was too low, and the perimeter density of the second-phase grains was too low. For this reason, Comparative Example 12 failed in strength after brazing heating.

Comparative Examples 13 to 21 included the chemical compositions falling out of the range provided in the present invention, and produced the following results.

In Comparative Example 13, the Fe content was too low, and the perimeter density of the second-phase grains was too low. For this reason, Comparative Example 13 failed in strength after brazing heating.

In Comparative Example 14, the Fe content was too high, and the grain size after brazing heating was minute. For this reason, Comparative Example 14 failed in brazability.

In Comparative Example 15, the Mn content was too low, and the perimeter density of the second-phase grains was too low. For this reason, Comparative Example 15 failed in strength after brazing heating.

In Comparative Example 16, the Mn content was too high, cracks occurred during cold rolling, and no fin material could be manufactured.

In Comparative Example 17, the Cu content and the Zn content were too high, and the melting point of the material was low. For this reason, Comparative Example 17 failed in brazability. In addition, because the self-corrosion speed increased, Comparative Example 17 failed in corrosion resistance.

In Comparative Example 18, the Cu content and the Zn content were too low, and the perimeter density of the second-phase grains and the specific resistance were too low. For this reason, Comparative Example 18 failed in strength after brazing heating. In addition, because it had a noble spontaneous potential, Comparative Example 18 failed in corrosion resistance.

Comparative Examples 19 included an excessive Ti content, Comparative Example 20 included an excessive Zr content, and Comparative Example 21 included an excessive Cr content. For this reason, in Comparative Examples 19 to 21, cracks occurred during cold rolling, and no fin materials could be manufactured.

Comparative Examples 22 to 24 included the manufacturing conditions falling out of the conditions provided in the present invention, and produced the following results.

In Comparative Example 22, the maximum achievable temperature of annealing in which annealing was performed at the highest temperature was too low, and the perimeter density of the second-phase grains was too low. For this reason, Comparative Example 22 failed in strength after brazing heating.

In Comparative Example 23, the maximum achievable temperature of annealing in which annealing was performed at the highest temperature was too high, and the perimeter density of the second-phase grains was too low. For this reason, Comparative Example 23 failed in strength after brazing heating.

In Comparative Example 24, the minimum value of the rolling shape ratio in the cold rolling step was too low, and the perimeter density of the second-phase grains was too low. For this reason, Comparative Example 24 failed in strength after brazing heating.

Comparative Examples 25 to 33 included the chemical compositions falling out of the range provided in the present invention, and produced the following results.

In Comparative Example 25, the Fe content was too low, and the perimeter density of the second-phase grains was too low. For this reason, Comparative Example 25 failed in strength after brazing heating.

In Comparative Example 26, the Fe content was too high, and the grain size after brazing heating was minute. For this reason, Comparative Example 26 failed in brazability.

In Comparative Example 27, the Mn content was too low, and the perimeter density of the second-phase grains was too low. For this reason, Comparative Example 27 failed in strength after brazing heating.

In Comparative Example 28, the Mn content was too high, cracks occurred during cold rolling, and no fin material could be manufactured.

In Comparative Example 29, the Cu content and the Zn content were too high, and the melting point of the material was low. For this reason, Comparative Example 29 failed in brazability. In addition, because the self-corrosion speed increased, Comparative Example 29 failed in corrosion resistance.

In Comparative Example 30, the Si content was too low, and the perimeter density of the second-phase grains and the specific resistance were too low. For this reason, Comparative Example 30 failed in strength after brazing heating.

Comparative Examples 31 included an excessive Ti content, Comparative Example 32 included an excessive Zr content, and Comparative Example 33 included an excessive Cr content. For this reason, in Comparative Examples 31 to 33, cracks occurred dining cold rolling, and no fin materials could be manufactured.

Comparative Examples 34 to 36 included the manufacturing conditions falling out of the conditions provided in the present invention, and produced the following results.

In Comparative Example 34, the maximum achievable temperature of annealing in which annealing was performed at the highest temperature was too low, and the perimeter density of the second-phase grains was too low. For this reason, Comparative Example 34 failed in strength after brazing heating.

In Comparative Example 35, the maximum achievable temperature of annealing in which annealing was performed at the highest temperature was too high, and the perimeter density of the second-phase grains was too low. For this reason, Comparative Example 35 failed in strength after brazing heating.

In Comparative Example 36, the minimum value of the rolling shape ratio in the cold rolling step was too low, and the perimeter density of the second-phase grains was too low. For this reason, Comparative Example 36 failed in strength after brazing heating.

INDUSTRIAL APPLICABILITY

The aluminum alloy fin material for a heat exchanger according to the present invention has high strength after brazing heating and excellent brazability, and enables reduction in thickness compared to conventional aluminum alloy fin materials. For this reason, the aluminum alloy fin material according to the present invention is useful, in particular, for heat exchangers of automobiles.

The invention claimed is:

1. An aluminum alloy fin material for a heat exchanger, the aluminum alloy fin material comprising an aluminum alloy including 0.5 mass % to 1.0 mass % of Si, 0.05 mass % to 0.7 mass % of Fe, 1.0 mass % to 2.0 mass % of Mn, 0.3 mass % to 1.2 mass % of Cu, and 2.2 mass % to 5.8 mass % of Zn, with the balance being Al and unavoidable impurities, wherein in an L-ST plane, second-phase grains having an equivalent circle diameter equal to or more than 0.030 μm and less than 0.50 μm have a perimeter density of 0.30

μm/μm$^2$ or more, second-phase grains having an equivalent circle diameter equal to or more than 0.50 μm have a perimeter density of 0.030 μm/μm$^2$ or more, wherein the perimeter density is the sum of the perimeters measured by imaging the second-phase grains divided by the imaging area, and specific resistance thereof at 20° C. is 0.030 μΩm or more.

2. The aluminum alloy fin material according to claim 1, wherein the aluminum alloy further includes at least one selected from 0.05 mass % to 0.3 mass % of Ti, 0.05 mass % to 0.3 mass % of Zr, and 0.05 mass % to 0.3 mass % of Cr.

3. A method for manufacturing the aluminum alloy fin material for a heat exchanger according to claim 1, the method comprising:

a casting step of acquiring a sheet-like ingot by a twin-roll type continuous casting rolling method; and a cold rolling step of subjecting the sheet-like ingot to cold rolling with at least one pass, to acquire the aluminum alloy fin material for a heat exchanger, wherein when L (mm) is a contact arc length between a roll and material in cold rolling in the cold rolling step, H (mm) is half of sum of thicknesses on a roller inlet side and a roller outlet side, and L/H is a rolling shape ratio, a minimum value of the rolling shape ratio of each pass of cold rolling in the cold rolling step is 1.0 or more, and at least one annealing is performed before a first pass, between a pass and another pass, or after a final pass in cold rolling in the cold rolling step, and a maximum achievable temperature of annealing performed at highest temperature in the at least one annealing is 370° C. to 520° C.

* * * * *